US009101168B2

(12) United States Patent
Patterson

(10) Patent No.: US 9,101,168 B2
(45) Date of Patent: Aug. 11, 2015

(54) UNDERSHIRT

(75) Inventor: Tom Patterson, San Diego, CA (US)

(73) Assignee: Tommy John, Inc., New York, NY (US)

( * ) Notice: Subject to any disclaimer, the term of this patent is extended or adjusted under 35 U.S.C. 154(b) by 715 days.

(21) Appl. No.: 12/338,742

(22) Filed: Dec. 18, 2008

(65) Prior Publication Data

US 2009/0249530 A1 Oct. 8, 2009

Related U.S. Application Data

(60) Provisional application No. 61/043,044, filed on Apr. 7, 2008.

(51) Int. Cl.
*A41B 9/06* (2006.01)

(52) U.S. Cl.
CPC ..... *A41B 9/06* (2013.01)

(58) Field of Classification Search
CPC ..... A41B 9/06; A41B 2400/38; A41B 1/00; A41D 1/18; A41D 2300/00; A41D 2300/22; A41D 1/04; A41D 2400/38; A41D 1/00; A41D 7/00; A41D 27/00; A41C 1/02; A41C 1/04
USPC ..... 2/113, 115, 77, 109, 106, 73, 90, 111, 2/78.2, 78.1, 114, 69, 105, 67, 243.1; D2/717, 720; 450/7, 11, 19, 30, 33, 3, 450/4, 20–22
See application file for complete search history.

(56) References Cited

U.S. PATENT DOCUMENTS 416,616 A * 12/1889 Holmes ..... 2/113
432,442 A * 7/1890 Sanford ..... 2/113
1,078,217 A * 11/1913 Querns ..... 2/113
D48,135 S * 11/1915 Taylor ..... D2/700
1,184,887 A * 5/1916 Sprague ..... 2/106
1,421,704 A * 7/1922 Mattern ..... 2/67
1,530,565 A 3/1925 Lindauer
1,653,288 A 12/1927 Johnson
1,813,043 A * 7/1931 Foreman ..... 2/67
1,899,022 A * 2/1933 Carl ..... 2/67
1,965,860 A * 7/1934 Rutledge ..... 450/20

(Continued)

FOREIGN PATENT DOCUMENTS

DE 3446326 A1 * 6/1986
DE 20301982 U1 * 4/2003

(Continued)

OTHER PUBLICATIONS

Sears advertisement, "4-Day Sale Men's Cotton Underwear", Beaver County Times, Jul. 10, 1968 (3 pages provided).*

(Continued)

*Primary Examiner* — Amy Vanatta

(74) *Attorney, Agent, or Firm* — Ted Sabety, Esq.; Sabety + Associates PLLC

(57) ABSTRACT

An undershirt in one embodiment includes a tubular torso portion comprising a resiliently deformable material, wherein an upper region of the torso portion has two openings for insertion therethrough of an intended wearer's arms, wherein the upper region is closed at a top of the undershirt except for a hole for insertion therethrough of an intended wearer's neck, wherein a lower region of the torso portion is at least partially tapered and is long enough to about cover an intended wearer's buttocks.

21 Claims, 4 Drawing Sheets

(56) References Cited

U.S. PATENT DOCUMENTS

| | | | | | |
|---|---|---|---|---|---|
| 2,046,861 | A | * | 7/1936 | Hildegard | 450/7 |
| 2,141,239 | A | | 12/1938 | Diamond | |
| D114,021 | S | * | 3/1939 | Karplus | D2/836 |
| 2,171,220 | A | * | 8/1939 | Martin | 2/90 |
| 2,222,090 | A | | 11/1940 | Schaumer | 2/113 |
| 2,308,337 | A | | 1/1943 | McDonald | 2/113 |
| 2,308,339 | A | * | 1/1943 | Mendenhall | 2/113 |
| 2,309,601 | A | | 1/1943 | Kneibler | A41B 9/06 |
| 2,309,822 | A | | 2/1943 | Blau | 2/113 |
| 2,310,103 | A | * | 2/1943 | McDonald | 2/113 |
| 2,315,975 | A | * | 4/1943 | Lilyan | 450/13 |
| 2,513,210 | A | * | 6/1950 | Rosenzweig | 2/90 |
| 2,609,541 | A | * | 9/1952 | Kaplan | 2/116 |
| 2,727,247 | A | | 12/1955 | Bailey | |
| 2,799,023 | A | * | 7/1957 | Goodman | 2/78.3 |
| 2,919,567 | A | * | 1/1960 | Loeper | 66/173 |
| 2,943,330 | A | | 7/1960 | Clyne | |
| 3,078,467 | A | * | 2/1963 | Artzt | 2/114 |
| 3,161,200 | A | * | 12/1964 | Brickman | 450/31 |
| 3,474,465 | A | * | 10/1969 | Artzt | 2/113 |
| 3,710,801 | A | * | 1/1973 | Bienenfeld | 450/123 |
| 3,739,398 | A | | 6/1973 | Sarmiento | |
| 3,776,157 | A | | 12/1973 | Szostak | |
| 3,949,426 | A | * | 4/1976 | George | 2/73 |
| 4,121,302 | A | | 10/1978 | Belpaume | 2/113 |
| 4,369,528 | A | | 1/1983 | Vest et al. | 2/69 |
| 4,480,339 | A | | 11/1984 | Hubbard, Sr. | |
| D294,995 | S | * | 4/1988 | Colledge | D2/840 |
| 5,177,814 | A | | 1/1993 | Courtney | |
| 5,283,908 | A | | 2/1994 | Martin | 2/69 |
| 5,343,564 | A | | 9/1994 | Reynolds et al. | 2/70 |
| 5,496,429 | A | | 3/1996 | Hasse et al. | |
| 5,667,422 | A | * | 9/1997 | Erwin | 450/30 |
| 5,819,317 | A | * | 10/1998 | Conway | 2/111 |
| 5,822,794 | A | * | 10/1998 | Allred | 2/115 |
| 6,061,832 | A | * | 5/2000 | Morrison, Jr. | 2/78.1 |
| 6,076,187 | A | * | 6/2000 | Wallerstein | 2/115 |
| D474,323 | S | * | 5/2003 | Carter | D2/717 |
| 6,892,396 | B2 | | 5/2005 | Uno et al. | 2/115 |
| 6,978,549 | B2 | * | 12/2005 | Ellis | 33/17 R |
| 7,905,117 | B2 | * | 3/2011 | Kronback | 66/176 |
| 8,185,970 | B2 | | 5/2012 | Summers et al. | |
| 8,568,195 | B1 | * | 10/2013 | Schindler | 450/30 |
| 8,578,517 | B2 | | 11/2013 | Alaniz et al. | |
| 8,578,518 | B1 | * | 11/2013 | Pflug | 2/117 |
| 2004/0154069 | A1 | | 8/2004 | Johnson et al. | 2/106 |
| 2005/0115281 | A1 | | 6/2005 | Mitchell et al. | 66/176 |
| 2006/0010559 | A1 | * | 1/2006 | Hamlet | 2/117 |
| 2006/0070166 | A1 | | 4/2006 | Matt et al. | 2/113 |
| 2007/0079428 | A1 | | 4/2007 | Nance et al. | |
| 2007/0094765 | A1 | | 5/2007 | Summers et al. | |
| 2007/0149093 | A1 | | 6/2007 | Lutz | 450/1 |
| 2008/0134409 | A1 | * | 6/2008 | Karasina | 2/117 |
| 2008/0229474 | A1 | * | 9/2008 | Fons et al. | 2/113 |
| 2009/0098801 | A1 | * | 4/2009 | Pedersen et al. | 450/7 |
| 2010/0192274 | A1 | * | 8/2010 | Karasina | 2/69 |
| 2013/0227758 | A1 | | 9/2013 | Doney | |
| 2013/0316617 | A1 | | 11/2013 | Freddi et al. | |
| 2014/0157492 | A1 | * | 6/2014 | Situm | 2/243.1 |

FOREIGN PATENT DOCUMENTS

| | | | | | |
|---|---|---|---|---|---|
| FR | 2145126 | | | 2/1973 | A41B 9/00 |
| GB | 2461755 | A | * | 1/2010 | A41C 1/02 |
| JP | 2007-51389 | A | * | 3/2007 | |

OTHER PUBLICATIONS

Jockey advertisement, "Only Jockey T-shirts are Power-Knit . . . Keep Their Fit", St. Joseph News-Press, Jun. 2, 1963 (3 pgs).*

Consumers Guide: Sears, Roebuck, and Company catalog, Issue 233, Item No. 83P5174F, Jan. 1, 1966 (2 pgs).*

Penney's advertisement, "Penney's 60th Anniversary: Towncraft Underwear", The Pittsburgh Press, Jul. 8, 1962 (3 pgs).*

"Extra-long T-shirt keeps working guys' assets hidden", by Korky Vann. The Post and Courier, Sep. 24, 2004 (3 pgs).*

Musser advertisement, "New T-Shirt Tapered Body", The Modesto Bee, Jun. 4, 1956 (3 pgs).*

B.R.Baker advertisement, "Boys' Tapered Muscle Shirts", Toledo Blade, Jun. 6, 1962 (3 pgs).*

Reis ad, "New Slim Look in Men's Underwear!", Schenectady Gazette, Aug. 18, 1966 (3 pgs).*

Grayson Products ad, "New!: The Latest Style Sensation, Bikini Briefs and Torso T' Shirt", Popular Science, Jun. 1960 (2 pgs).*

"Slim Inches Away in the Amazing New Body Taper-Trim Shirt", Black Belt magazine, Nov. 1976 (2 pages).* http://www.hanes.com/Hanes/Products/Men-Hanes/Men_ShopByCategory-Hanes/Men_Tshirts-Hanes/Men_Tshirts_Underwear-Hanes/114830.aspx.

* cited by examiner

UNDERSHIRT

RELATED APPLICATIONS

This application claims priority to U.S. Provisional Application No. 61/043,044, filed Apr. 7, 2008, which is herein incorporated by reference.

BACKGROUND

The present invention relates to clothing, and more particularly, this invention relates to undershirts.

There are several problems with undershirts currently on the market.

- The undershirts typically do not fit a wearer's torso correctly. This is because undershirts currently on the market are made with standard dimensions (usually A-frame or box cut) or slim fitting dimensions (narrower box cut).
- The undershirts generally "ride up" above the belt line when the wearer moves (i.e., the wearer stands up from a chair, the wearer gets in and out of cars, the wearer sits down, etc.). They ride up above the belt line because undershirts currently on the market fit too loosely below the belt and are not the proper length.
- The undershirts often shrink to a smaller size after only a few wears and washings, unless they are purchased too large initially.
- The undershirts are typically made of cheap material that does not breathe well.
- The undershirts generally cause the wearer's overshirt, such as a button-down dress shirt, to pull up, ride up, and/or bunch up on the sides and back making the wearer's silhouette look bigger than it actually is, and may potentially cause the wearer to be self-conscious about the overshirt's current condition.
- The undershirts generally do not fit according to how they are shown in advertisements, on packaging, and/or on models.
- The undershirts have a tendency to become untucked from inside of pants due to the box cut design.

A strong need exists for men to have an alternative to traditional undershirt garments. Traditional undershirts create undesirable bunching, riding up, and often come untucked quickly; especially when worn with slim fitting dress shirts, button down dress shirts, sweaters, and T-shirts. Also, in addition to the unattractive bunching appearance, as the traditional undershirts become untucked, they can cause discomfort and insecurity to the wearer. This also creates bulges under the outer clothing and the undershirt, if it is worn by itself.

One alternative to traditional undershirt garments is known as a men's tank top or "wifebeater." This type of undergarment is comprised of a tight, form fitting, sleeveless, box cut design so it contours the torso. However, this undergarment offers no underarm sweat absorption due to the omitted sleeves. Additionally, it has an undesirable look and is generally frowned upon in business settings where dress shirts are worn because the wearer is likely to perspire and sweat in the armpit areas which can visibly be seen through a colored overshirt or dress shirt.

These traditional types of undergarments do not provide the wearer with an improved appearance under clothing and can be uncomfortable. Furthermore, they do not hold in bulges or help to keep the overshirt and undershirt tucked in. This is known as the "ride up effect" resulting in the shirt riding up above the beltline of the wearer while their overshirt is tucked in. Although traditional "undershirts" cover these areas, they normally are made of relatively thick material and designed short in length, which creates bulging and bunching above the beltline. Also, the thick fabric, box cut design, and standard length usually makes the wearer look heavier when wearing slim and regular fitting clothing, rather than thinner in appearance as is desired by most wearers.

Accordingly, a need exists for a men's undershirt undergarment that does not bunch up, bulge on the sides, ride up above the beltline, and become easily untucked. A need also exists for such an undershirt undergarment manufactured in a tailored design, longer length, while incorporating both natural and/or synthetic blends of stretch fabric.

SUMMARY

An undershirt in one embodiment includes a tubular torso portion comprising a resiliently deformable material, wherein an upper region of the torso portion has two openings for insertion therethrough of an intended wearer's arms, wherein the upper region is closed at a top of the undershirt except for a hole for insertion therethrough of an intended wearer's neck, wherein a lower region of the torso portion is at least partially tapered and is long enough to about cover an intended wearer's buttocks.

An undershirt in another embodiment includes a tubular torso portion comprising a resiliently deformable material, wherein an upper region of the torso portion has two openings for insertion therethrough of an intended wearer's arms, wherein the upper region is closed at a top of the undershirt except for a hole for insertion therethrough of the intended wearer's neck, wherein a lower region of the torso portion is at least partially tapered and is long enough to about cover the intended wearer's buttocks, wherein a width of the torso portion of the undershirt tapers smaller from the top of the undershirt towards a bottom of the undershirt.

An undershirt according to another embodiment includes a tubular torso portion comprising a resiliently deformable material, wherein an upper region of the torso portion has two openings for insertion therethrough of an intended wearer's arms, wherein the upper region is closed at a top of the undershirt except for a hole for insertion therethrough of the intended wearer's neck, wherein a lower region of the torso portion is at least partially tapered, wherein an upper region of the torso portion above the lower portion is not tapered, wherein a junction of the upper and lower regions is near a location where the intended wearer's belly button will be when the undershirt is worn, wherein a ratio of a width at the bottom of the undershirt to a width at a middle of the arm openings is between about 1:0.92 and about 1:1.31.

Other aspects and embodiments of the present invention will become apparent from the following detailed description, which, when taken in conjunction with the drawings, illustrate by way of example the principles of the invention.

DETAILED DESCRIPTION

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

One embodiment of the present invention is an undershirt. In general, the undershirt comprises a tubular torso portion, a neck opening at the top of the torso portion, and, in a T-shirt configuration, arm openings which may include no sleeves, or have short sleeves, or long sleeves extending therefrom. In the configuration where no sleeves are present, there still may be some member coupled to the arm openings, such as a piece of material to form an upper covering on the shoulder.

The undershirt may have a crew neck design, a v-neck design, a tank top design, a turtle neck design, etc. In addition, graphics, logos, words, etc., may appear on internal and/or external surfaces of the undershirt, such as manufacturer's information relating to cleaning on the inside and a logo on the exterior indicating the manufacturer. A tagless screen-print, tagless heat transfer label, and/or woven care label may be provided near the neckline or some other internal area, e.g., with information such as undershirt size, care instructions, construction, etc. The tagless labels may eliminate tag chafe.

Also, the undershirt may be comprised of a single or different fabric(s). One example of the use of a different fabric may be to use heat transfer material near hot spots, such as under the arms.

Figure 1:
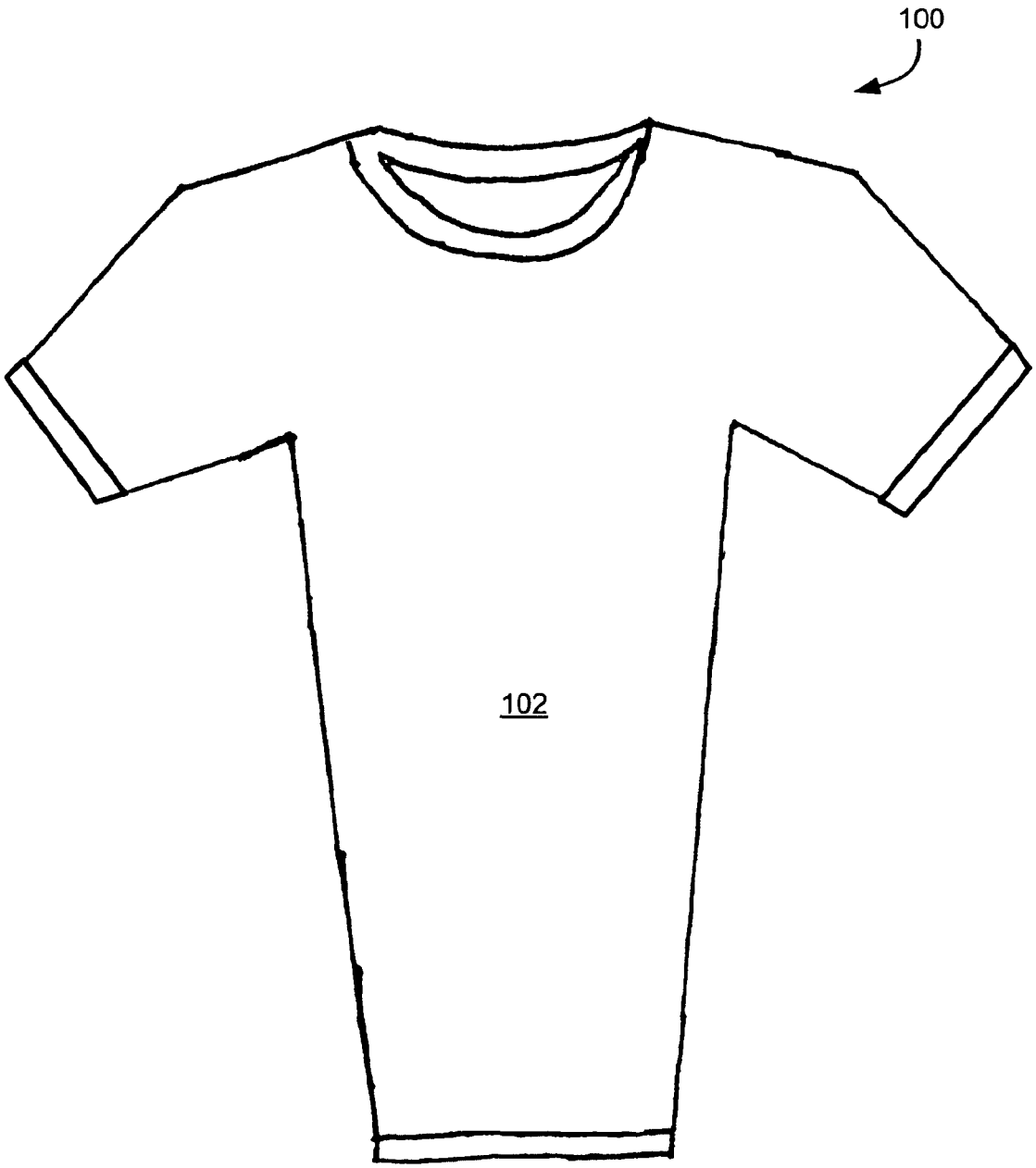
FIG. 1 is a front view of an undershirt according to one embodiment.
Figure 2:
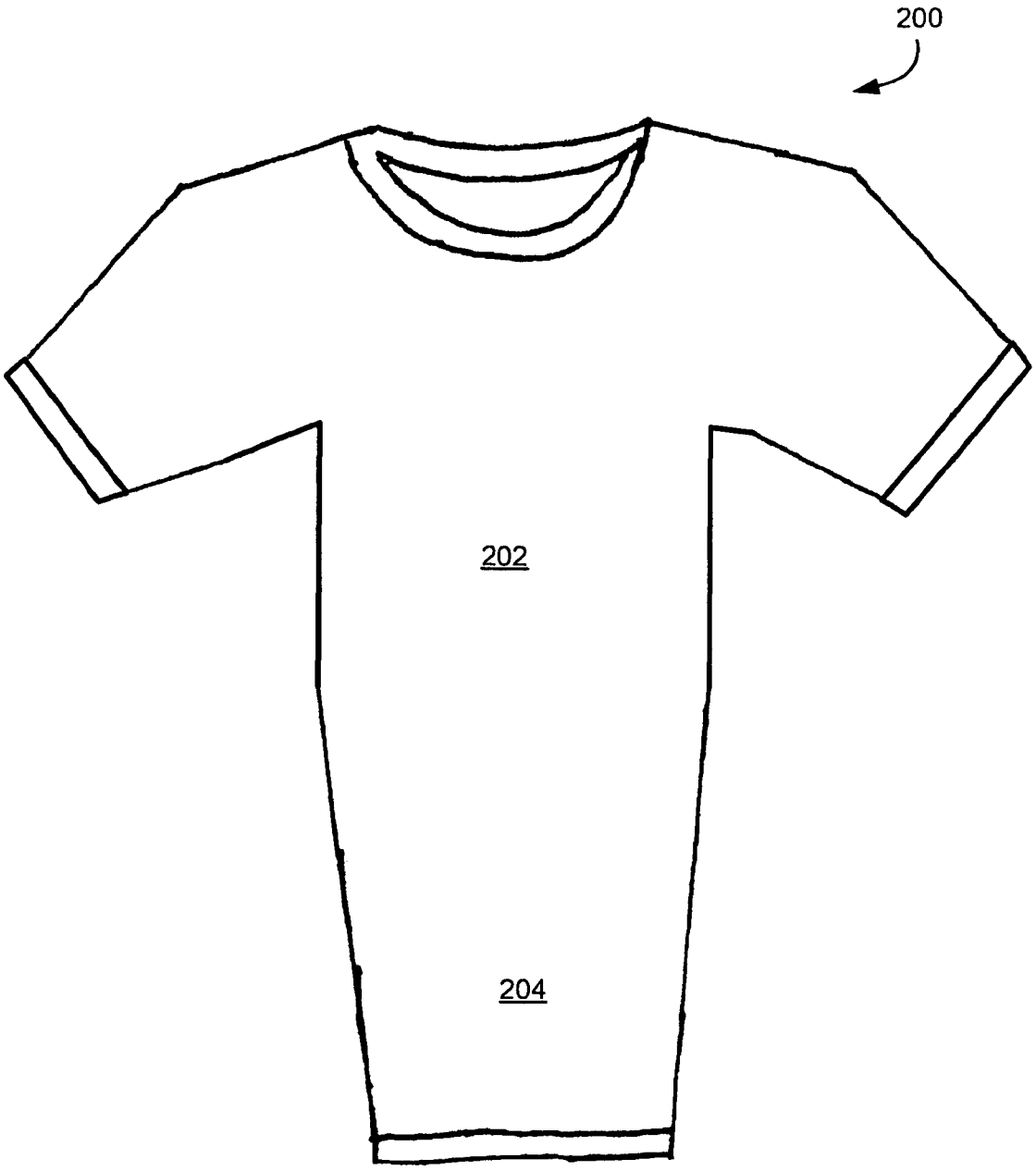
FIG. 2 is a front view of an undershirt according to one embodiment.
Figure 3:
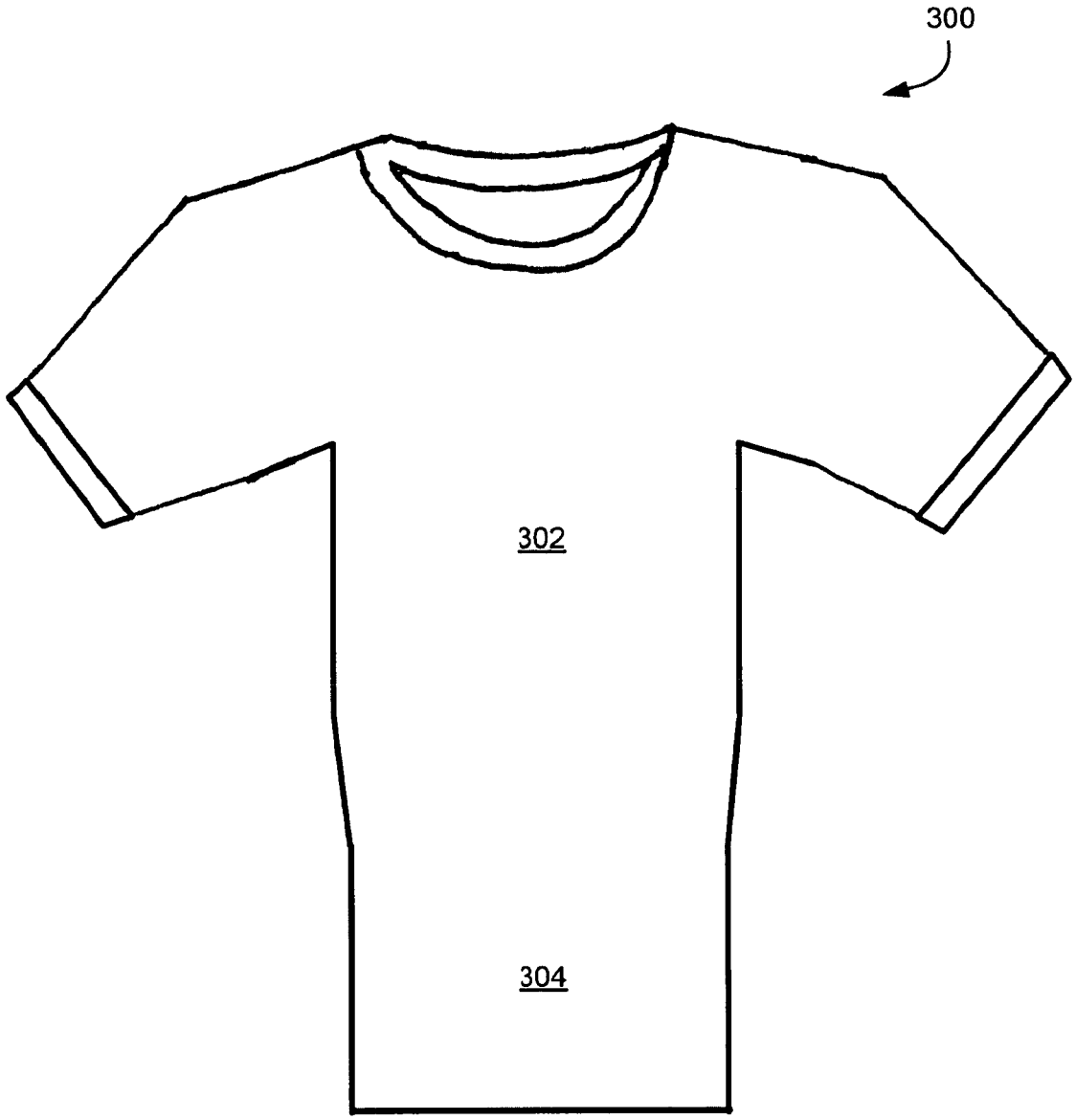
FIG. 3 is a front view of an undershirt according to one embodiment.

In one approach, as shown in the undershirt 100 of FIG. 1, the entire torso portion 102 (the portion below the arm openings) tapers together from the top down towards the bottom. In another approach, as shown in the undershirt 200 of FIG. 2, the torso portion has an upper section 202 and a lower section 204. The lower section 204 tapers together from its junction with the upper section 202 towards the bottom. The taper may be gradual, more pronounced near the junction, or only tapering for a portion of the lower section near the junction. In yet another approach, as shown in the undershirt 300 of FIG. 3, the entire upper portion 302 has a constant width, while a section of the lower portion 304 has a constant width, with a section of the lower portion 304 being tapered. In addition, the constant width section of the lower portion 304 has a smaller width than the upper portion 302.

Preferably, the lower region of the undershirt is long enough to about cover the buttocks of an intended wearer. In the preferred embodiment, the lower region extends below the widest girth of the buttocks of the intended wearer. This enhancement is critical to keep the undershirt tucked into the pants or shorts for longer periods of time without the undershirt becoming untucked than would a typical undershirt. In addition, the smaller diameter and elasticity of the material in the lower portion, particularly in areas which will be adjacent to the buttocks of the intended wearer, may assist in preventing the undershirt from riding up.

In one approach, the undershirt may be at least 2 inches longer than any undershirt on the market, according to size (S, M, L, XL, XXL, L Tall, XL Tall, XXL Tall, etc.).

The material from which the undershirt is fabricated may include a resiliently deformable (e.g. elastic and/or stretchy with ability to return about to prestretched form) material, and preferably includes a manmade fabric. In one approach, the undershirt may comprise viscous modal and Lycra™. Lycra™ exhibits an elastic recovery of at least 93%. In another approach, the undershirt may comprise micro modal and Lycra™. In another approach, the undershirt may comprise Spandex™ and/or Lycra™. Note that portions of the undershirt may be of the resiliently deformable material, while other portions may be formed of another material or several other materials. The resiliently deformable material that meets the characteristics described herein inherently has a modulus that is low enough that the shirt will not bunch up while being worn, due to too much elasticity in the mid-section, while having sufficient modulus so that the portion of the shirt surrounding the buttocks remains snug and resists riding up while the mid-section remains form-fitting but not tightly restrictive. The undershirt preferably comprises a breathable material.

In a particularly preferred approach, the junction of the upper and lower portions may be near a location where the intended wearer's belly button will be when the undershirt is worn. In another approach, the junction is above this point.

In another approach, the taper may begin, cross, or end about at a location where the intended wearer's belly button will be when the undershirt is worn.

The undershirt has specific application in wearing under dress shirts, fitted shirts, body-conscious sweaters, layering under other tight fitting shirts, and by itself as a T-shirt.

In another approach, at least a portion of the undershirt has sufficient resilient deformability to compress at least about 2% of a circumference of a body of the intended wearer when the undershirt is worn, e.g., the waist or tummy area of the wearer may be compressed to approximate a slimmer silhouette.

In some approaches, a ratio of a width at the bottom of the undershirt to a width at a middle of the arm openings may be between about 1:0.92 and about 1:1.31. These ratios are critical for producing an undershirt which does not bunch up, untuck, or gather unsightly in areas.

In even more approaches, a ratio of a width at a waist of the undershirt to a width of the undershirt at the lowest point of the arm openings may be between about 1:0.97 and about 1:1.42. These ratios are also critical for reasons stated above.

In more approaches, a ratio of a length from the lowest point of the arm openings to the bottom to a length from a front neckline to the bottom may be between about 1:1.22 and about 1:1.51. These ratios are critical for producing an undershirt which does not become untucked, stays in place over extended wearing times, and does not bunch under areas of stretching and movement, such as near the sides of the stomach of an intended wearer.

Although the wearer may consider it a given that the wearer's undershirt fits properly, many male shirt wearers do not realize the importance of a properly fitting undershirt. On one hand, if the wearer's undershirt is too tight, the wearer will be uncomfortable shortly after putting the undershirt on. On the other hand, if the wearer's undershirt is too large, the wearer may become irritated with the excess material around the sleeves, bottom and sides of the undershirt, along with the problems associated with bunching and untucking. The wearer's undershirt should fit loosely enough so that the wearer has room to breathe and move, but not enough room so that material bunches or works against the wearer's objectives of a clean, slim look.

Figure 4B:
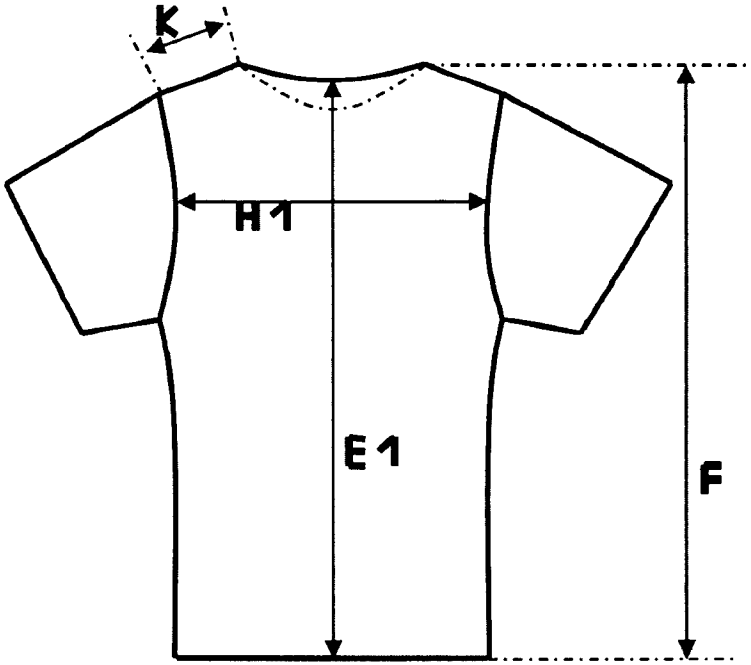
FIG. 4B is a back view of an undershirt showing dimensions according to one embodiment.
Figure 4A:
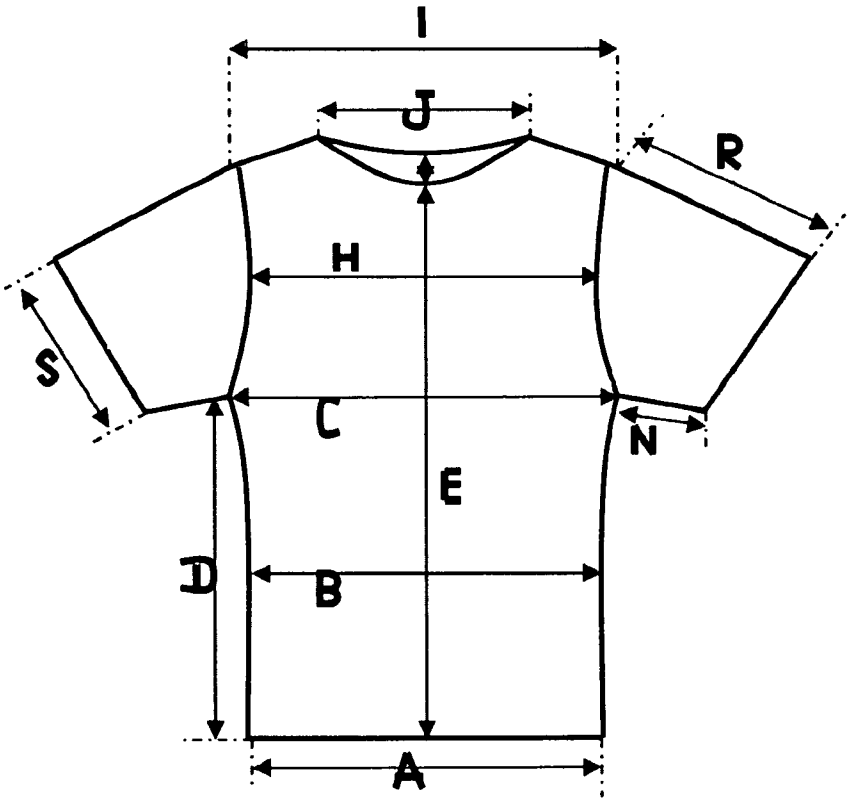
FIG. 4A is a front view of an undershirt showing dimensions according to one embodiment.

Table 1, below, illustrates exemplary dimensional ranges (in inches) of various shirts in different sizes (S, M, L, XL, XXL), with reference to FIGS. 4A and 4B. Each of the range of dimensions listed in Table 1 is shown in FIG. 4A or FIG. 4B. These dimensional ranges are exemplary only, and in no way are intended to limit the invention.

TABLE 1

| | | S | M | L | XL | XXL |
|---|---|---|---|---|---|---|
| | FRONT | | | | | |
| A | Bottom | 13"-14" | 14"-16" | 15"-17" | 16"-18" | 17"-19" |
| B | Waist | 13"-15" | 15.5"-17.5" | 17"-19" | 18"-20" | 19"-21" |
| C | Width at bottom of arm openings | 16.5"-18.5" | 17.5"-19.5" | 18.5"-20.5" | 19.5"-21.5" | 20.5"-22.5" |
| D | Length from bottom to under arm openings | 16.5"-18.5" | 17.5"-19.5" | 18.5"-20.5" | 19.5"-21.5" | 20.5"-22.5" |
| E | Length from bottom to front neckline | 22.5"-24.5" | 24.5"-26.5" | 25.5"-27.5" | 26.5"-28.5" | 27.5"-29.5" |
| F | Length to top | 27"-29" | 28"-30" | 29"-31" | 30"-32" | 31"-33" |
| H | Width at middle of front arm openings | 15"-17" | 15"-17" | 16.5"-18.5" | 17.5"-19.5" | 17.5"-19.5" |
| I | Shoulder width | 15"-17" | 15"-17" | 16.5"-18.5" | 17"-19" | 18.5"-20.5" |
| J | Neck width | 5.75"-7.75" | 6"-7" | 6.25"-8.25" | 6.5"-8.5" | 6.75"-8.75" |
| K | Strap width | 3.75"-5.75" | 4"-6" | 4.25"-6.25" | 4.5"-6.5" | 4.75"-6.75" |
| R | Sleeve length top | 6.75"-8.75" | 7"-9" | 7.5"-9.5" | 7.5"-9.5" | 7.75"-9.75" |
| S | Sleeve opening | 4"-6" | 4.5"-6.5" | 4.5"-6.5" | 5"-7" | 5.25"-7.25" |
| N | Sleeve length bottom | 2"-4" | 2.25"-4.25" | 2.25"-4.25" | 2.25"-4.25" | 2.5"-4.5" |
| | BACK | | | | | |
| E1 | Length from bottom to back neckline | 27"-29" | 28"-30" | 29"-31" | 29"-31" | 31"-33" |
| H1 | Width at middle of back arm openings | 14.5"-16.5" | 15.5"-17.5" | 16.5"-18.5" | 17.5"-19.5" | 18.5"-20.5" |

Table 2, below, illustrates exemplary ratios between certain dimensions taken from the shirts shown in FIGS. 4A and 4B. The first ratio (A:H) is the bottom width compared to the width at the middle of the arm openings. The second ratio (B:C) is the waist width compared to the width at the bottom of the arm openings. The third ratio (D:E) is the length from the bottom to the chest under the arm openings compared to the length from the bottom to the front neckline. As can be seen in Table 2, the ratios change depending on whether the shirt is a smaller size or a larger size (S, M, L, XL, XXL). However, for purposes of this invention, a general ratio can be taken from somewhere in between the lowest and highest ratios for each dimensional ratio.

TABLE 2

| | S | M | L | XL | XXL |
|---|---|---|---|---|---|
| RATIO | A:H | A:H | A:H | A:H | A:H |
| Largest | 1:1.31 | 1:1.21 | 1:1.23 | 1:1.22 | 1:1.15 |
| Smallest | 1:1.07 | 1:0.94 | 1:0.97 | 1:0.97 | 1:0.92 |
| RATIO | B:C | B:C | B:C | B:C | B:C |
| Largest | 1:1.42 | 1:1.26 | 1:1.21 | 1:1.19 | 1:1.18 |
| Smallest | 1:1.1 | 1:1 | 1:0.97 | 1:0.98 | 1:0.98 |
| RATIO | D:E | D:E | D:E | D:E | D:E |
| Largest | 1:1.48 | 1:1.51 | 1:1.49 | 1:1.46 | 1:1.44 |
| Smallest | 1:1.22 | 1:1.26 | 1:1.24 | 1:1.23 | 1:1.22 |

In a particularly preferred embodiment, a men's undershirt garment is provided. The undershirt garment provides the user with form fitting resiliently deformable fabric, a tailored cut design, and because the undershirt length is longer than most, it allows the undershirt to stay tucked in. It is the first undergarment to solve the untucking, bunching on the sides, and riding up effect of the undershirt garment while allowing overshirts to comfortably slide over the undergarment. In some embodiments, the undershirt may be worn under dress shirts, button down shirts, suits, sweaters, and layering under other shirts or garments.

The lower region of the undershirt is long enough to about cover the buttocks of the intended wearer. The stretch fabric and tailored cut design conforms to the mid and lower torso, allowing the undershirt to stay tucked in giving men the form fitting, smooth, streamlined look they want when they want to look their best. The form fitting tailored design extends down almost past the buttocks. This provides a slimming and tailored appearance over the front, side, and rear angles of the "innertube" portions of the body. The unique design is critical for allowing the undershirt to stay tucked in even during repetitive movements and long periods of wear. Additionally, the undershirt does not force the user to readjust and tuck in the undershirt, saving time, appearances, and energy. The overall design provides the user with a smooth, form fitting, tucked in appearance when worn under clothing or by itself, without causing the user to suffer discomfort or insecurity.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An undershirt characterized as having a predetermined size for an intended wearer of a predetermined corresponding size, comprising:

a tubular torso portion comprising a resiliently deformable material comprised of fibers having an elastic recovery of at least 93%;

wherein an upper region of the torso portion has two arm openings for insertion therethrough of the intended wearer's arms, short tubular sleeves or long tubular sleeves coupled to the two arm openings, wherein the upper region is closed at a top of the undershirt except for a hole for insertion therethrough of the intended wearer's neck, wherein a lower region of the torso portion has a single opening at a bottom, is at least partially tapered, where the taper is characterized by the ratio of the width of the bottom of the shirt to the width at a waistline of the shirt being greater than 1:1 and less than or equal to about 1:1.13 and is long enough to cover the intended wearer's buttocks below the line of the furthest girth of the buttocks, wherein a ratio of a length from a line between a first and second lowest points of the two arm openings to the bottom to a length from a lowest point of the front neckline to the bottom is equal to about 1:1.22 or greater, in order that the resilient deformability of the fabric comprising the lower region causes the lower region to adhere to the intended wearer's buttocks so as to prevent the torso portion from substantially shifting out of position, wherein the deformable material is a fabric with a modulus low enough that the undershirt will not bunch up while being worn, due to too much elasticity in the torso, while having sufficient modulus so that the portion of the undershirt surrounding the buttocks remains snug and resists riding up while the torso remains form-fitting but not restrictive.

2. An undershirt as recited in claim 1, wherein a ratio of a width at a waist of the undershirt to a width of the undershirt at the lowest point of the arm openings is between about 1:1 and about 1:1.42.

3. An undershirt as recited in claim 1, wherein at least a portion of the undershirt has sufficient resilient deformability to compress a circumference of a body of the intended wearer by at least about 2% when the undershirt is worn.

4. An undershirt as recited in claim 1, wherein the torso portion gradually tapers together along an entire length thereof from the two arm openings down to the bottom.

5. An undershirt as recited in claim 1, wherein the resiliently deformable material is manmade.

6. An undershirt as recited in claim 1, wherein the torso portion consists essentially of a manmade fabric.

7. The undershirt of claim 1 wherein an end of the lower region of the tubular torso portion is circular.

8. The undershirt of claim 1 where the deformable material exhibits an elasticity that produces about a 2% compression of the circumference of the midsection of the intended wearer when the shirt is worn.

9. An undershirt characterized as having a predetermined size for an intended wearer of a predetermined corresponding size, comprising:

a tubular torso portion comprising a resiliently deformable material comprised of fibers having an elastic recovery of at least 93%, wherein an upper region of the torso portion has two arm openings for insertion therethrough of the intended wearer's arms, wherein the upper region is closed at a top of the undershirt except for a hole for insertion therethrough of the intended wearer's neck, wherein a lower region of the torso portion has a single opening at a bottom, is at least partially tapered and is long enough to cover substantially all of the intended wearer's buttocks, wherein a width of the torso portion of the undershirt tapers smaller from the width of the undershirt at a line between a first and second lowest points of the two arm openings to the bottom of the undershirt, wherein the length from a lowest point along the front neckline to the bottom of the undershirt divided by the width of the bottom of the undershirt is equal to or greater than about 1.55, in order that the resilient deformability of the fabric comprising the lower region causes the lower region to adhere to the intended wearer's buttocks so as to prevent the torso portion from substantially shifting out of position when the shirt is worn, wherein the deformable material is a fabric with a modulus low enough that the undershirt will not bunch up while being worn, due to too much elasticity in the torso, while having sufficient modulus so that the portion of the undershirt surrounding the buttocks remains snug and resists riding up while the torso remains form-fitting but not restrictive.

10. An undershirt as recited in claim 9, wherein a ratio of a width at a waist of the undershirt to a width of the undershirt at the lowest point of the arm openings is between about 1:1 and about 1:1.42.

11. An undershirt as recited in claim 9, wherein at least a portion of the undershirt has sufficient resilient deformability to compress a circumference of a body of the intended wearer by at least about 2% when the undershirt is worn.

12. An undershirt as recited in claim 9, further comprising short tubular sleeves or long tubular sleeves coupled to the arm openings.

13. The undershirt of claim 9 where the deformable material exhibits an elasticity that produces about a 2% compression of the circumference of the midsection of the intended wearer when the shirt is worn.

14. An undershirt characterized as having a predetermined size for an intended wearer of a predetermined corresponding size, comprising:

a tubular torso portion comprising a resiliently deformable material comprised of fibers, said fibers having an elastic recovery of at least 93%, wherein an upper region of the torso portion has two arm openings for insertion therethrough of the intended wearer's arms, short tubular sleeves or long tubular sleeves coupled to the arm openings, wherein the upper region is closed at a top of the undershirt except for a hole for insertion therethrough of the intended wearer's neck, wherein a lower region of the torso portion has a single opening at a bottom, is at least partially tapered where the taper is characterized by the ratio of the width of the bottom of the shirt to the width at a line between a first and second lowest points of the two arm openings is equal to about 1:1.18 or greater and is long enough to cover the intended wearer's buttocks below the line of the furthest girth of the buttocks, wherein the length from a lowest point along the front neckline to the bottom of the undershirt divided by the width of the bottom of the undershirt is equal to or greater than about 1.55, in order that the lower region adhere tightly to the buttocks and that the resilient deformability of the fabric comprising the lower region prevents the torso portion from substantially shifting out of position when the undershirt is worn, wherein the deformable material is a fabric with a modulus low enough that the undershirt will not bunch up while being worn, due to too much elasticity in the torso, while having sufficient modulus so that the portion of the undershirt surrounding the buttocks remains snug and resists riding up while the torso remains form-fitting but not restrictive.

15. An undershirt as recited in claim 14, wherein a ratio of a width at a waist of the undershirt to a width at a line between a first and second lowest points of the two arm openings is between about 1:1 and about 1:1.42.

16. The undershirt of claim 14 where the deformable material exhibits an elasticity that produces about a 2% compression of the circumference of the midsection of the intended wearer when the shirt is worn.

17. An undershirt characterized as having a predetermined size for an intended wearer of a predetermined corresponding size, comprising:

a tubular torso portion comprising a resiliently deformable material comprised of fibers, said fibers having an elastic recovery characteristic of at least 93%, wherein an upper region of the torso portion has two openings for insertion therethrough of the intended wearer's arms, wherein the upper region is closed at a top of the undershirt except for a hole for insertion therethrough of the intended wearer's neck, wherein a lower region of the torso portion has a single opening at a bottom, tapers from the width of the undershirt at a line between a first and second lowest points of the two arm openings to the bottom and is long enough to cover a sufficient portion of the intended wearer's buttocks, in order that the lower region adhere tightly to the buttocks, wherein a ratio of the length from the line between the lowest points of the two arm openings to the bottom to a length from a lowest point of the front neckline to the bottom is equal to about 1:1.22 or greater, and that the resilient deformability of the fabric comprising the lower region prevents the torso portion from substantially shifting out of position when the undershirt is worn, wherein the deformable material is a fabric with a modulus low enough that the undershirt will not bunch up while being worn, due to too much elasticity in the torso, while having sufficient modulus so that the portion of the undershirt surrounding the buttocks remains snug and resists riding up while the torso remains form-fitting but not restrictive.

18. An undershirt as recited in claim 17, wherein the length from a lowest point along the front neckline to the bottom divided by the length between a first and second lowest points of the two arm openings is less than or equal to about 1.40.

19. An undershirt as recited in claim 17, wherein a ratio of a width at a waist of the undershirt to a width of the undershirt at the lowest point of the arm openings is between about 1:1 and about 1:1.42.

20. An undershirt characterized as having a predetermined size for an intended wearer of a predetermined corresponding size, comprising:

a tubular torso portion comprising a resiliently deformable material comprised of elastic fibers, wherein an upper region of the torso portion has two openings for insertion therethrough of the intended wearer's arms, short tubular sleeves or long tubular sleeves coupled to the arm openings, wherein the upper region is closed at a top of the undershirt except for a hole for insertion therethrough of the intended wearer's neck, wherein a lower region of the torso portion has a single opening at a bottom, and tapers smaller from the width of the undershirt at the line between a first and second lowest points of the two arm openings to the bottom and is long enough to cover the intended wearer's buttocks below the line of the furthest girth of the buttocks, where the length from the lowest point on the front neckline to the bottom divided by the width of a waistline of the undershirt is greater than about 1.40 and less than about 1.73 in order that the resilient deformability of the fabric comprising the lower region causes the lower region to adhere to the intended wearer's buttocks so as to prevent the torso portion from substantially shifting out of position when the undershirt is worn, wherein the deformable material is a fabric with a modulus low enough that the undershirt will not bunch up while being worn, due to too much elasticity in the torso, while having sufficient modulus so that the portion of the undershirt surrounding the buttocks remains snug and resists riding up while the torso remains form-fitting but not restrictive.

21. The undershirt of claim 20 where the deformable material exhibits an elasticity that produces about a 2% compression of the circumference of the midsection of the intended wearer when the shirt is worn.

* * * * *